US005518252A

United States Patent [19]

Uhl

[11] Patent Number: 5,518,252

[45] Date of Patent: May 21, 1996

[54] STORAGE ENCLOSURE FOR SOCCER NET ASSEMBLY

[76] Inventor: Christopher D. Uhl, 76 Cattaragus Dr., Rochester, N.Y. 14623

[21] Appl. No.: 493,336

[22] Filed: Jun. 21, 1995

[51] Int. Cl.[6] ..... A63B 63/04

[52] U.S. Cl. ..... 273/400

[58] Field of Search ..... 273/400

[56] References Cited

U.S. PATENT DOCUMENTS

| | | | |
|---|---|---|---|
| 5,186,469 | 2/1993 | Terris | 273/400 |
| 5,273,292 | 12/1993 | Pardi et al. | 273/400 |
| 5,308,082 | 5/1994 | Bigelow | 273/400 |
| 5,346,227 | 9/1994 | Amram et al. | 273/400 |
| 5,413,356 | 5/1995 | Bigelow | 273/400 |

*Primary Examiner*—William H. Grieb
*Attorney, Agent, or Firm*—Harris Beach & Wilcox

[57] ABSTRACT

A soccer goal frame and net assembly which includes a goal frame having two vertical support members and a horizontal crossbar connected to the vertical support members. An elongated enclosure which is designed to hold and secure a soccer net assembly is secured to the crossbar, with a soccer net contained within the enclosure with one edge of said net being permanently fastened within said enclosure, and a pair of support poles each containing a free end and a fixed end rotatably mounted respectively at each end of the enclosure. The poles are moveable from a stored position to a locked support position and in the locked position the poles extend perpendicular to the horizontal axis of the enclosure and provide support for the net.

16 Claims, 5 Drawing Sheets

STORAGE ENCLOSURE FOR SOCCER NET ASSEMBLY

BACKGROUND OF THE INVENTION

The present invention relates to a storage enclosure for a soccer net assembly, and more specifically for a system which secures and protects the net assembly when not in use, and which forms an integral part of the soccer goal support.

An object of the present invention is to provide for a compact storage enclosure for a soccer net assembly which forms an integral part of the soccer goal support, and when not in use secures the net and support structure against vandalism and the like.

A further object of the present invention is to provide a storage and support system that is integral with the goal support and allows a soccer net assembly to be expeditiously installed at the time of the game, and which obviates the need for transporting nets and support apparatus to and from the playing field.

A common problem associated with maintaining a soccer field is that soccer nets are commonly vandalized and rendered unsuitable for use. This requires that a new net must be purchased and installed at the site. This event is time consuming, and results in needless costs to the user.

A further problem associated with maintenance of a soccer field is with regard to the cutting and care of the grass surface. Field maintenance must move or remove the net and support structure when using grass cutting equipment. If the net cannot be conveniently moved or removed, the grass in the goal net area cannot be effectively cut and becomes long and unsightly.

Soccer nets are commonly left in place when the soccer field is not being used, and further include support stakes and other structures which are left in place, and can cause injuries to the players during play, and to others who pass by when the soccer field is not in use. These situations pose a potential liability problem for the owner of the property. If the nets are taken down after the field is no longer in use, because of the potential liability and/or safety factor, a significant time factor is also involved in this operation. A typical time for the installation of a soccer net is approximately one half hour to complete the task. If the nets are not taken down after use and the net is left in place, the net becomes vulnerable to weathering, and also to the potential liability and vandalism described above.

The prior art has attempted, in part, to address the problems described above as illustrated by U.S. Pat. Nos. 5,186,469; 5,273,292 and 5,308,082.

U.S. Pat. No. 5,186,469 relates to a foldable soccer goal which can be stored. This invention discloses the soccer goal having a U-shaped open ended frame in which the legs of the frame form goal posts and a cross connecting base element which forms the cross bar. When the frame is pivoted to be co-planar with the housing, it nests within the housing in its stored position. When the frame is pivoted to a vertical position, it pulls the net structure from a roller in the housing and forms a soccer goal. The invention of the '469 patent teaches a device which is positioned in place on the ground, and as a result is a hazard and an impediment to lawn maintenance in its stored position.

U.S. Pat. No. 5,273,292 relates to a portable soccer goal assembly which according to the patentee can be easily erected and taken down. The structure, includes a frame which defines a goal opening having an inverted U-shape with the free end of the legs of the U-structure being adapted to stand freely on a ground surface, with outrigger means secured to the free ends of the legs of the U-structure, with the outrigger being of a weight and length to counterbalance the weight of the frame. The '292 patent structure does not address the problem of securely storing a net when not in use, and the assembly must be moved to and from the soccer field.

U.S. Pat. No. 5,308,082 is directed to a soccer net storage compartment. The storage compartment, which rests upon the ground, comprises a U-shaped compartment member connected to extend rearwardly of the goal post and cross piece. The structure of the '082 patent in the stored position presents a hazard and impediment, as described above, in that it is positioned on the ground behind the goal support.

It is therefore an object of the present invention to overcome the problems and disadvantages of the prior art described above.

SUMMARY OF THE INVENTION

The present invention is directed to an enclosure device which stores and secures a soccer net assembly when the field is not in use.

The invention includes an elongated enclosure which is permanently mounted on the back of the cross bar of any existing soccer goal. A soccer net and a pair of side support poles are neatly and compactly stored inside the enclosure. The enclosure contains one or more doors or panels which can be locked to secure the contents when the net assembly is not in use. One long edge or length of the net is permanently supported or fastened within the enclosure with the pair of support poles each respectively positioned at opposite ends of the enclosure. The poles are each fixed at one end within the enclosure and are rotatably moveable from a stored position to a locked position. When in the locked position, the poles extend perpendicular to the horizontal axis of the cross bar and provide support for the sides of the net.

In one embodiment, each support pole is spring loaded at its fixed end to provide resistance to movement when in locked engagement within locking means contained at each end of the enclosure. The net is permanently fastened at the back of the enclosure and draped over each support pole at the sides. When the support poles are rotatably moved horizontally from the stored position to the locked position, they move the net out to the sides and define the rectangular net area for the soccer goal assembly.

DETAILED DESCRIPTION OF THE INVENTION

Figure 1:
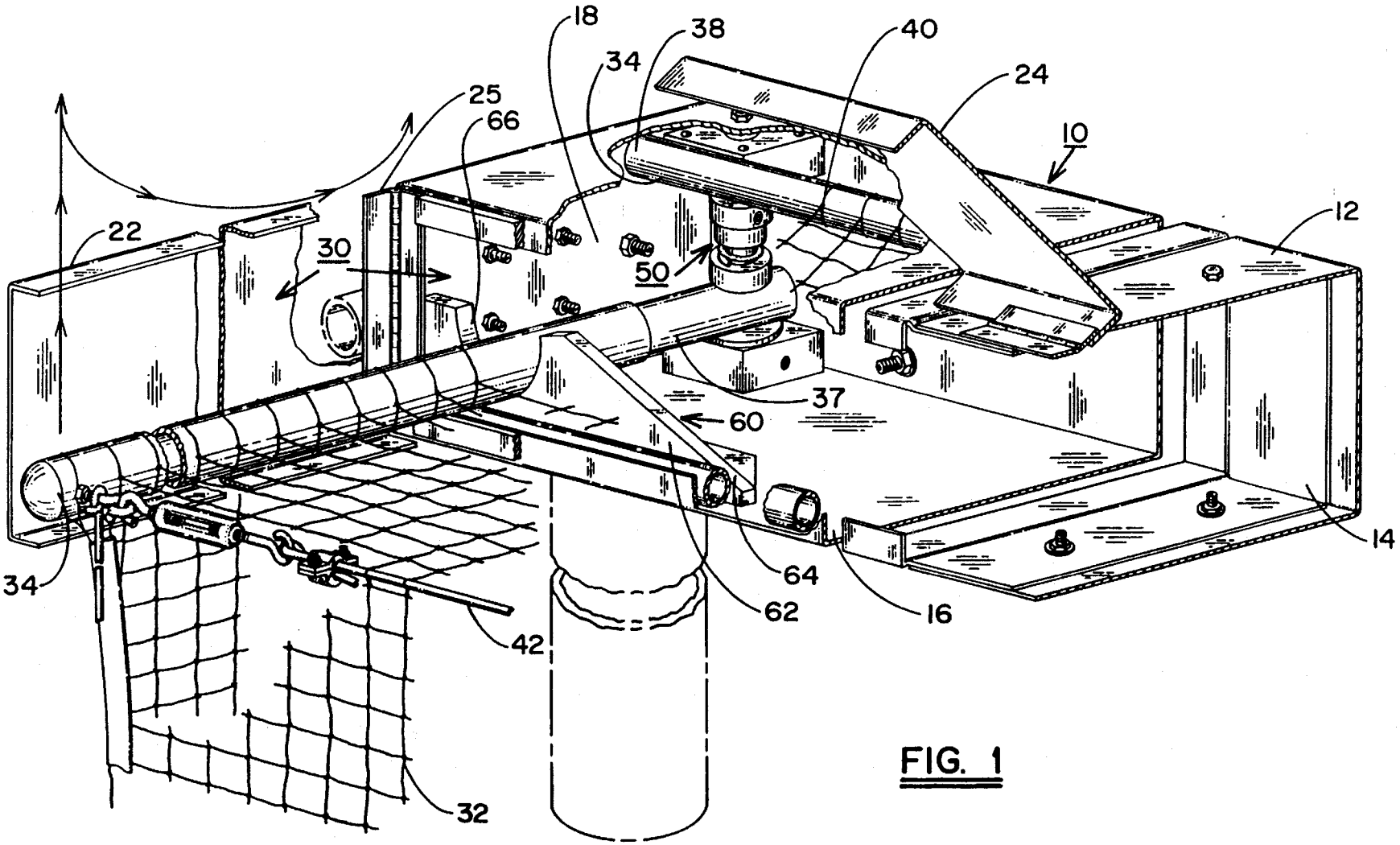
FIG. 1 is a perspective view of the left side of the enclosure with the pole in the locked position.
Figure 2:
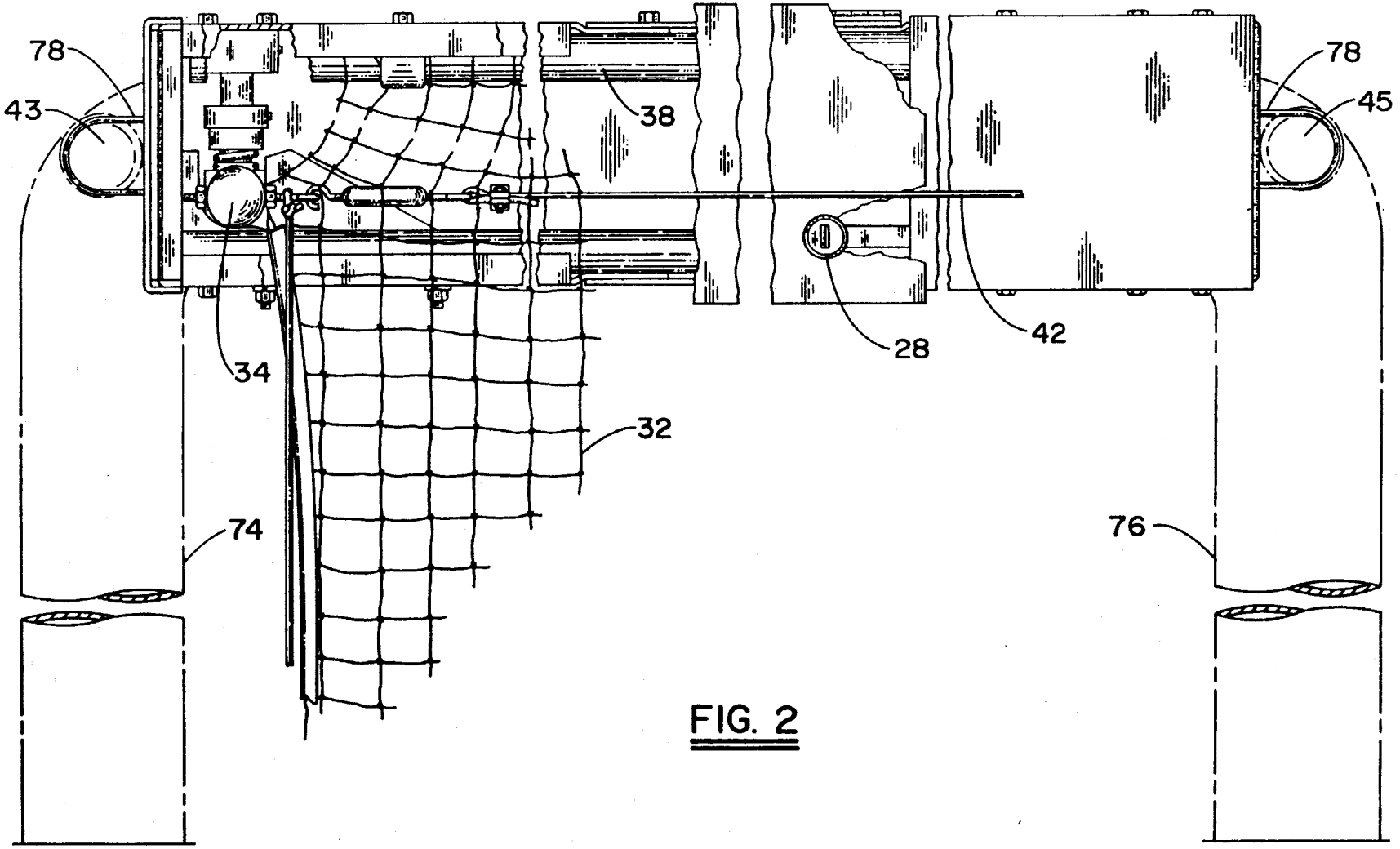
FIG. 2 is a partial cut away view of the enclosure illustrating the structure of the left side of the enclosure.

Referring to the Figs. of the drawings, and in particular FIGS. 1 and 2, the present invention relates to a storage enclosure 10 for a soccer net assembly 30. In one embodiment, the enclosure is in the form of an elongated rectangular member preferably made of metal, which stores and secures a soccer net assembly when the soccer field is not in use. The enclosure 10 comprises an interconnected top 12, back plate 14, bottom 16, end plates 18 and 20, and moveable and lockable front panels 22, 24 and 26 as shown more fully in FIGS. 1, 4 and 5. The enclosure structure is preferably bolted together with the moveable panels being hinged at 25. The moveable end panels 22 and 26 are preferably hinged to move to the sides and can be used to display advertising on their outer surfaces. When the soccer field is not in use, a soccer net 32 and a pair of support poles 34 and 36 are stored within the space defined by the enclosure in a manner to be more fully described herein.

Figure 3:
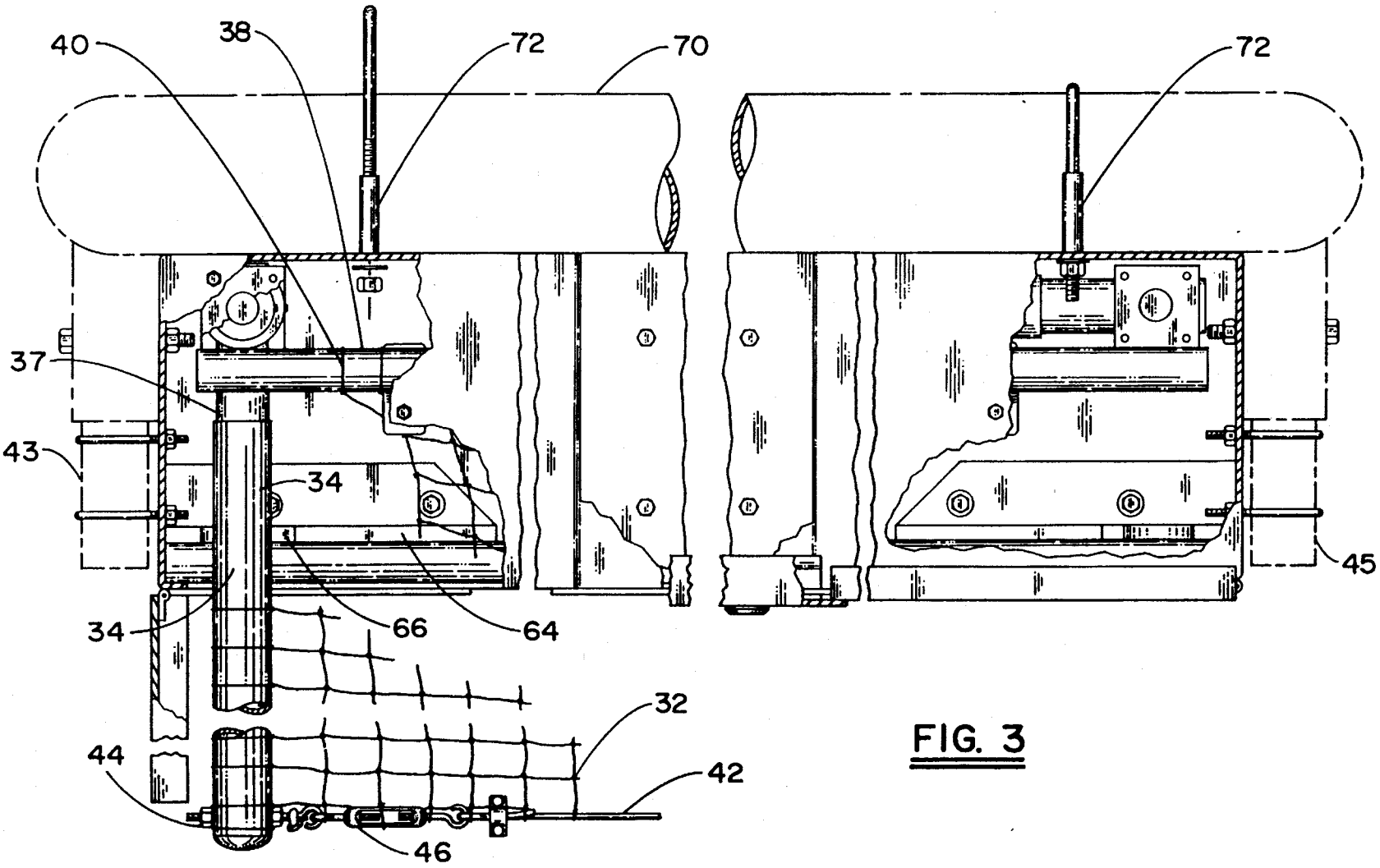
FIG. 3 is a partial cut away top or plan view of the enclosure.

The net 32 is mounted at the back of enclosure 10 on a metal pole 38, using a series of fasteners or ties 40 (FIGS. 1 and 3). The net 32 is similarly fastened to support poles 34 and 36. Each of support poles 34 and 36 has a free end and a fixed end which is mounted in a tension spring assembly 50. The fixed end of each of poles 34 and 36 is hollow and fits over a support pole coupling 37 of assembly 50 as shown in FIGS. 1, 3 and 6. Poles 34 and 36 are rotated horizontally from the stored position in enclosure 10 to a locked support position through the use of a detent assembly 60 as shown in FIGS. 1–3. Assembly 60 comprises a metal plate 62 having an inclined surface 64 and a recessed or detent groove 66. In operation, the support pole is rotated horizontally outwardly about tension spring assembly 50 from the stored position and rides up incline surface 64 and then drops into detent groove 66, and is held in place due to the action of tension spring assembly 50 to be described herein in greater detail. The pair of detent assemblies are located respectively at each end of the storage enclosure and are fixed in place by bolts or by welding. One long edge of the net 32 is permanently fastened within the enclosure as previously described and draped over and fastened over each of poles 34 and 36 at the sides to define the rectangular net area for the soccer goal assembly when poles 34 and 36 are in the locked position as illustrated in FIGS. 1, 2, 3 and 5.

A cable 42 is bolted using eye bolts 44 to the free end of poles 34 and 36 respectively in order to support to the back of the net when it is being used. The cable applies pressure to the pole extension when they are locked in the detent groove 66. The cable can also include a turnbuckle 46 to adjust the cable slack and tension for the net weight. The cable also functions to provide a 90° angle at the rear of the goal area so that balls can be retrieved from the netted area with ease. This feature eliminates players being tangled in the net and crawling around which is a common problem in conventional soccer net setups.

Panels 22, 24 and 26 are hinged at 25 and can be conveniently provided with any suitable locking means 28 in order to secure the net assembly when in the stored position.

The tension spring assembly 50 which holds poles 34 and 36 in place is illustrated in FIGS. 1, 2, 3 and 6. The assembly comprises a top mounting block 51 and a lower mounting block 52. Each block contains 4 holes 59 to enable the blocks 51 and 52 to be secured to the enclosure with machine screws (not shown). Each block is provided with a bore 57 in its center to accommodate and hold a center shaft 53 in fixed engagement. Center shaft 53 supports poles 34 and 36 through elongated bore 35 of support pole coupling 37 at the fixed end of poles 34 and 36 as illustrated in FIGS. 1, 2 and 6. The spring assembly further includes a side-split locking collar 54, a tension spring 55, and a pair of spring cups 56 on either side of the spring, and a plastic washer 58 between the lower mounting block 52 and pole 34. When the spring is tensioned to a switchable resistance of the support pole, split locking collar 54 is tightened in place around the shaft 53 holding the set spring tension in place. To help accommodate this vertical movement, the bore 35 of support pole coupling 37 is provided with elongated flat side walls 39 to allow for the wobbling vertical movement of poles 34 and 36 against spring assembly 50 when forces are exerted against the net. The resistant spring tension on the support pole arm allows the support pole to be pushed upward and spring back in place. This mechanism holds the support pole in the locking detent groove 66 when the net is fully extended during play of the soccer game. This will allow the net assembly to withstand the shock of a soccer ball being kicked into the netted goal area.

As can be seen from the above description, the poles 34 and 36 are spring loaded to absorb the impact of any level of soccer play. They are conveniently mounted in the back of the enclosure, and can be adjusted to fine tune the resistance. When the poles are moved up the incline 64 of detent, assembly 60, the springs 55 at the fixed ends of the poles are compressed, putting more force on the poles, and then pushing them tightly into place within the detent groove 66. Even though the spring assembly is meant to keep the poles in place, poles 34 and 36 are still able to be pulled out of groove 66 and slide back down incline 64 into enclosure 10 with ease. Using an Allen wrench, the tension put on the poles can be increased or decreased through collar 54. This enables the user to keep a consistent resistance on each of poles 34 and 36.

FIG. 3 illustrates the details of the storage enclosure 10 as mounted on goal cross bar 70. The storage enclosure 10 is positioned behind the existing upper cross bar 70 and is also attached to it. It is attached using U-bolts 72 for circular bars and square bolts for square bars. The nuts and bolts are tightened from the inside to prevent tampering by vandals. The storage enclosure is further attached to the side goal posts 74 and 76 by U-bolts 78 attached to horizontal support pipes 43 and 45.

Figure 4:
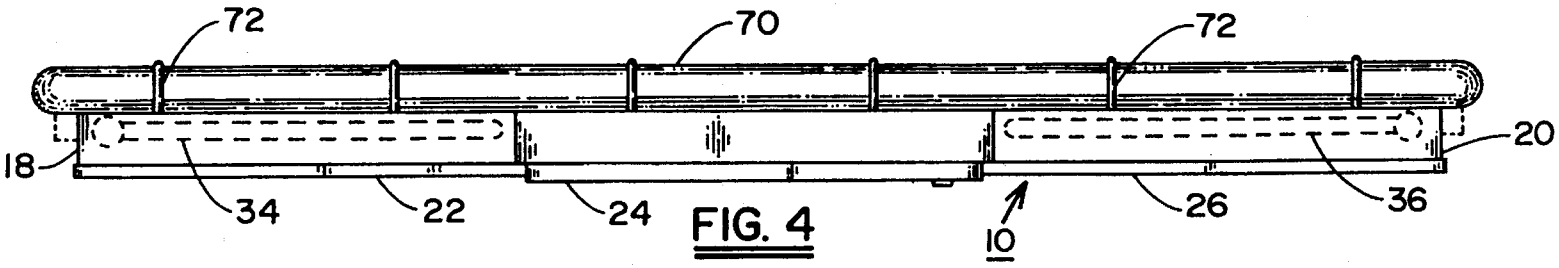
FIG. 4 is a schematic top plan view of the enclosure and the net assembly in the stored position.
Figure 5:
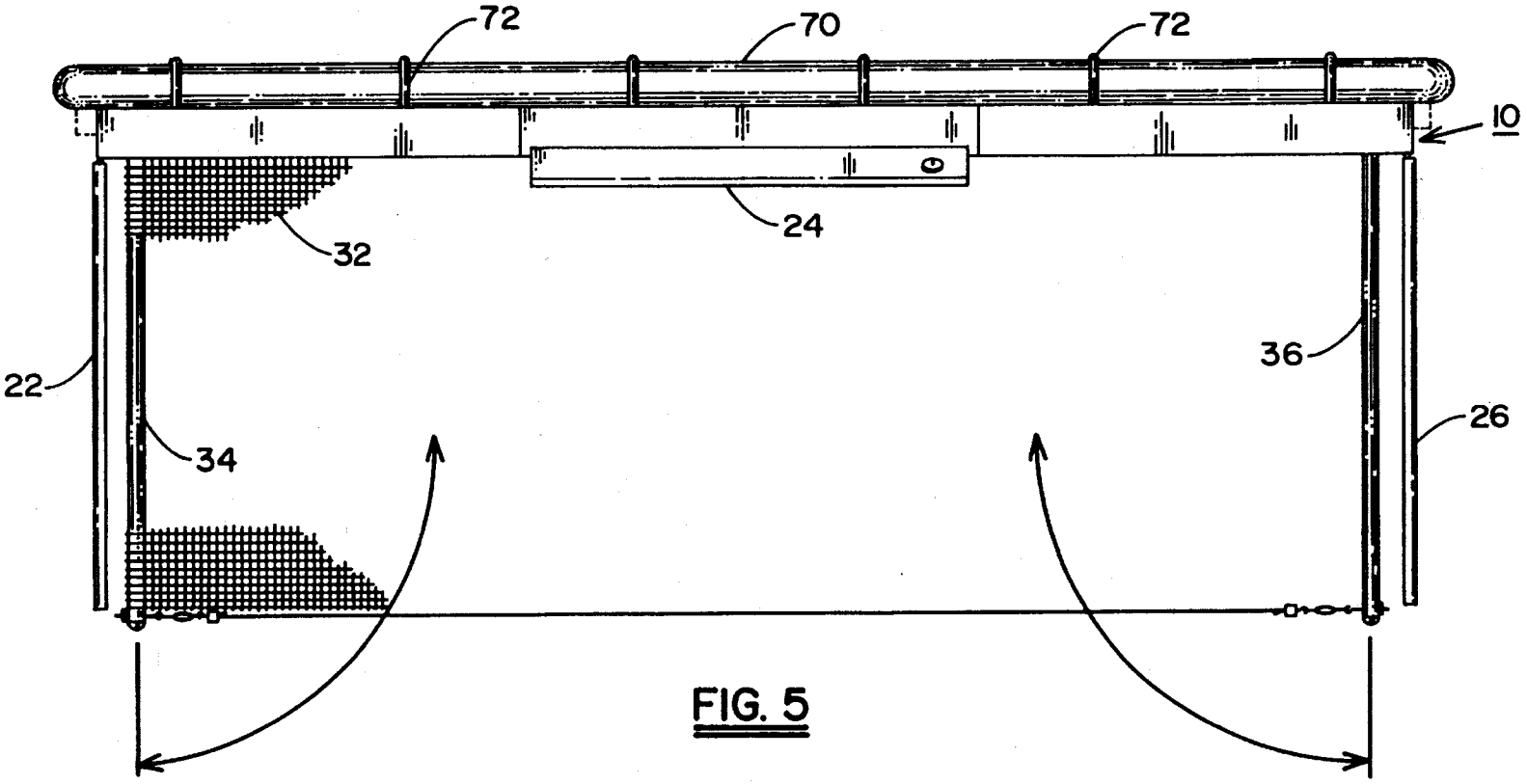
FIG. 5 is a view of FIG. 4 with the net assembly removed from the enclosure in place for play.
Figure 6:
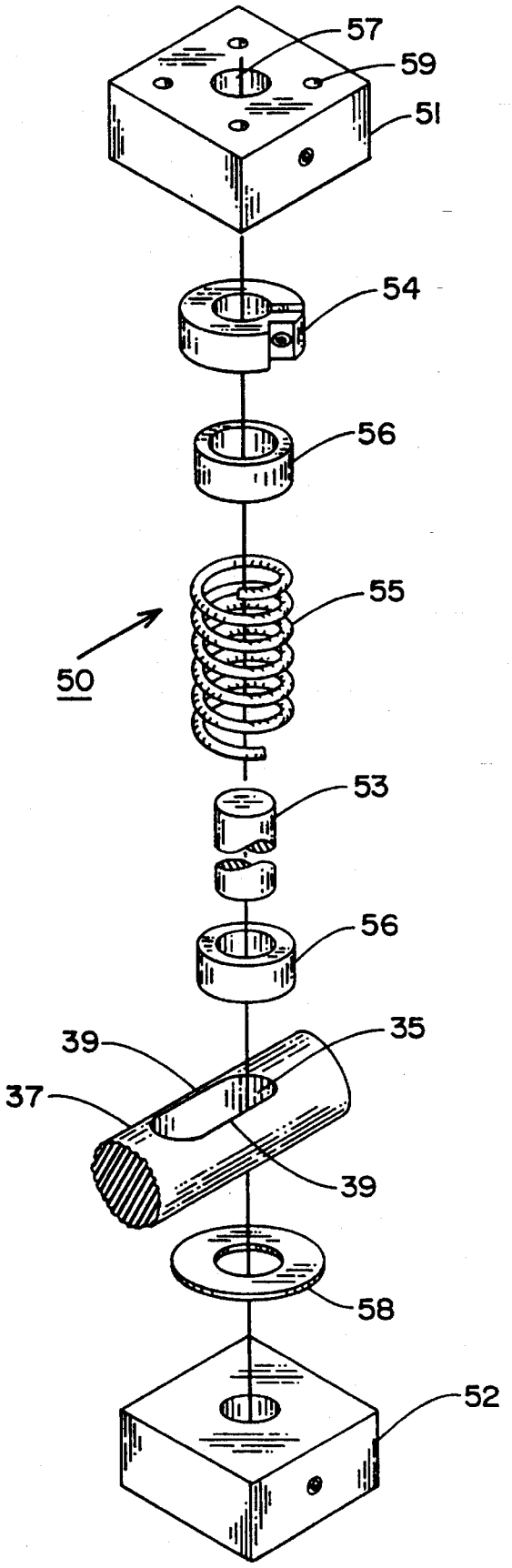
FIG. 6 is an exploded view of the tension spring assembly.

FIGS. 4 and 5 schematically illustrate the net 32 and side poles 34 and 36 in the stored and operating modes, respectively. FIG. 4 shows the supporting crossbar 70 with enclosure 10 attached by U-bolts 72. FIG. 5 illustrates the net in the fully extended operating position with support poles 34 and 36 in the locked position, and end panels 22 and 26 opened to the sides of the net.

As can be seen from the drawings and the above description, the present invention provides for a device and system for securely storing a soccer net assembly which comprises an integral part of a soccer goal support. Because of the location of the enclosure behind the cross bar of the goal support, in the stored position the net assembly of the present invention allows for ease of maintenance of the ground surrounding the soccer goal support. The present invention further secures the net assembly, when not in use, against vandalism, and eliminates the risk of injury to people passing by when a field is not in use.

The enclosure is designed to fit both round and square goal post frames, and is adjustable to fit varying goal post widths. The ends of the enclosure typically utilize U-bolts to mount to the cross bar of the net support poles. Plastic tie wraps are typically used to stretch the goal net and attaching it to the goal poles. The system of the present invention is preferably of a bolted construction. This construction avoids drilling at the site during installation, and provides ease of construction using only hand tools. Although the enclosure is preferably made of metal other suitable materials or combination of materials such as plastics, fiberglass or wood may also be used.

While the device and system shown herein is disclosed in detail and is capable of obtaining the objects and providing the advantages described herein, it should be understood that the disclosure is merely illustrative of the presently preferred embodiments of the present invention, and that no limitations are intended with respect to the detail of construction as shown herein, other than as defined in the appended claims.

I claim:

1. A storage enclosure for a soccer net assembly which comprises;

(a) an elongated enclosure which defines an inner storage space and which is adapted to be mounted on the cross bar of a soccer goal, said enclosure further containing at least one moveable panel to provide access to said inner storage space;

(b) a soccer net contained within said enclosure with one edge of said net being permanently fastened within said enclosure; and (c) a pair of support poles each containing a free end and a fixed end rotatably mounted respectively at each end of said enclosure, and moveable from a stored position to locked support position, wherein in said locked position said poles extend perpendicular to the horizontal axis of said enclosure, and provide support for said net.

2. The enclosure of claim 1 in which locking means for said support poles are contained at each end of said enclosure.

3. The enclosure of claim 2 in which the locking means include a fixed plate which contains a detent to receive and hold the support pole in place.

4. The enclosure of claim 3 in which each support pole is spring loaded at its fixed end to provide resistance to movement when in locked engagement within said locking means.

5. The enclosure of claim 1 in which the free end of each support pole contains means to support the top of the back of the net.

6. The enclosure of claim 5 in which the support means for the back of the net comprises a wire or cable connected to the free end of each support pole.

7. The enclosure of claim 6 in which the support means for the top of the net includes means to adjust the tension of the wire or cable.

8. The enclosure of claim 1 in which said enclosure is rectangular in shape and contains at least one moveable door or panel which contains locking means to secure the contents of the enclosure when the net assembly is in a stored position.

9. A soccer goal frame and net assembly which includes a goal frame having two vertical support members and a horizontal crossbar connected to said vertical support members, the improvement comprising:

(a) an elongated enclosure which is designed to hold and secure a soccer net assembly, said enclosure being secured to said crossbar (b) a soccer net contained within said enclosure with one edge of said net being permanently fastened within said enclosure; and (c) a pair of support poles each containing a free end and a fixed end rotatably mounted respectively at each end of said enclosure, and moveable from a stored position to a locked support position wherein in said locked position said poles extend perpendicular to the horizontal axis of said enclosure and provide support for said net.

10. The enclosure of claim 9 in which locking means for said support poles are contained at each end of said enclosure.

11. The enclosure of claim 9 in which the locking means include a fixed plate which contains a detent to receive and hold the support pole in place.

12. The enclosure of claim 9 in which each support pole is spring loaded at its fixed end to provide resistance to movement when in locked engagement within said locking means.

13. The enclosure of claim 9 in which the free end of each support pole contains means to support the top of the back of the net.

14. The enclosure of claim 9 in which the support means for the back of the top of the net comprises a wire or cable connected to the free end of each support pole.

15. The enclosure of claim 14 in which the support means for the top of the net includes means to adjust the tension of the wire or cable.

16. The enclosure of claim 9 in which said enclosure is rectangular in shape and contains at least one moveable door or panel which contains locking means to secure the contents of the enclosure when the net assembly is in a stored position.

* * * * *